United States Patent [19]

Ratliff

[11] 4,250,715

[45] Feb. 17, 1981

[54] HEAT TRANSFER SYSTEMS

[76] Inventor: Frank W. Ratliff, P. Box 78, 1930 Zaventem 2 Luchthaven, Brussels, Belgium

[21] Appl. No.: 50,971

[22] Filed: Jun. 22, 1979

Related U.S. Application Data

[63] Continuation-in-part of Ser. No. 19,478, Mar. 12, 1979, abandoned.

[51] Int. Cl.[3] ..... F25B 1/06

[52] U.S. Cl. ..... 62/175; 62/500

[58] Field of Search ..... 62/500, 191, 323 R, 62/324 B, 238 C, 2, 199, 175; 237/2 B

[56] References Cited

U.S. PATENT DOCUMENTS

| | | | |
|---|---|---|---|
| 3,150,498 | 9/1964 | Blake | 62/199 X |
| 3,242,679 | 3/1966 | Puckett et al. | 62/2 |
| 3,699,779 | 10/1972 | Schlichtig | 62/324 B |

*Primary Examiner*—William E. Wayner
*Attorney, Agent, or Firm*—Charles H. Lindrooth

[57] ABSTRACT

Heat transfer systems utilizing the standard vapor/compression refrigeration cycle with commonly available refrigerant fluids are disclosed. The embodiments disclosed provide switching means for selective use of the equipment for cooling or for heating in preferred form. In some embodiments, only the heating or only the cooling capability of a system is utilized. Common to the embodiments is a system for pressurizing the refrigerant fluid utilizing a heat source such as a solar collector, waste heat from a generator, automobile engine or other power plant, or even a small gas or electrical heater or the like. Equipment including a venturi device for drawing refrigerant at low pressure through an evaporator for cooling purposes and for extraction of heat from the atmosphere for heating purposes is also disclosed.

9 Claims, 5 Drawing Figures

HEAT TRANSFER SYSTEMS

CROSS-REFERENCE TO RELATED APPLICATION

This application is a continuation-in-part of my copending application Ser. No. 19,478, filed Mar. 12, 1979, now abandoned.

FIELD OF THE INVENTION

This invention relates to heat transfer systems using the standard vapor/compression refrigeration cycle, and more particularly, to systems using a heat source in place of a mechanical compressor as a means for transferring energy to known refrigerant fluid medium in a standard vapor/compression refrigeration system. In its preferred form, the invention selectively utilizes the heat of vaporization of the heat of condensation of the refrigeration medium, thereby functioning as a cooling or heating system as required.

BACKGROUND OF THE INVENTION

The standard Carnot reversible heat pump cycle, as simplified by use of a throttling valve for expansion of the refrigerant fluid and a mechanical compressor for compression of the fluid, has been in use for a wide variety of applications for heating and for cooling for many years and is so well-known as to require little explanation. It should be sufficient for the purposes of this application to explain that in the cooling mode, such systems pass saturated liquid refrigerant through an expansion valve to a lower pressure. This is a constant enthalpy process and the temperature of the refrigerant falls to the saturation temperature at the final pressure because of the latent heat demanded by the vaporization. The refrigerant is then passed through an evaporator wherein heat is absorbed from the atmosphere or from some other medium which it is desired to cool. The refrigerant vapor is then drawn into a compressor and compressed to a temperature at which a cooling medium, which may be ambient air, can condense the refrigerant vapor as it passes through a condenser. The cycle is frequently reversible so that when the system operates as a heat pump, with the energy added to the system being supplied by the compressor and by the ambient air, it is used to supply heat to a flow system such as the interior of a building. The present invention relates to improvements and simplifications of the above described system in which a heat source, as an energy supply, is substituted for the mechanical compressor now in widespread use as an energy source.

SUMMARY AND OBJECTS OF THE INVENTION

In summary, an important aspect of the invention is the direct substitution of a heat source for a mechanical compressor as the main source of energy added to a refrigerant fluid in a vapor/compression heating-cooling system. One important advantage and a prime object of the invention, is that it enables the use of waste heat, a small heater, or heat from a source such as a solar collector as the energy source in a cooling-heating system. Assuming an insulated system, all of the heat energy is transferred to the refrigerant. As one example of a system wherein waste heat might be employed, the invention has applicability in automobile heating and air-conditioning systems. Since waste heat will be the primary energy source in such a system, substantial fuel savings in automobiles equipped with air-conditioners become possible. The invention has applicability to chemical and power generating processes involving steps of heating and cooling wherein excess heat is available at one point in the process and heating or cooling capacity can be availed of at another point. Since the invention involves the use of few moving parts, life of equipment is increased, maintenance problems are reduced, and initial cost can be much lower in comparison to conventional mechanical systems. These advantages are important objects of the invention.

Another object of the invention is an improvement in the efficiency of heat pumps and refrigeration or air-conditioning equipment of the type utilizing the vapor-compression cycle. In use for heating, the invention takes advantage of the known heat pump concept of multiplication of utilizable energy in that energy transferred to the system from a mechanical energy source results in a transfer of additional energy from the atmosphere ultimately resulting in a greater transfer of utilizable energy to a system to be heated than was acquired from the mechanical energy source.

Still another important objective of the invention, which involves important advantages over the prior art, arises out of the capability of the system to effectively use the heat energy supplied from a solar collector system as a cooling means. The system makes use of the heat from the solar collecting system at the time when the solar system is operating at its maximum efficiency, which also happens to be the time when maximum cooling is needed. In the heat pump mode of operation the invention provides for extraction of heat from the atmosphere as a means of supplementing the heat supplied by the collector in cold weather when the collector efficiency is lower.

Thus, another object of the invention, in a heat pump system, is the use of a circuit which makes use of atmospheric heat for heating purposes even when atmospheric temperatures are well below freezing.

Various other objects and advantages of the invention will become apparent upon reference to the following detailed description of illustrative embodiments of the invention, and from the accompanying drawings in which.

Figure 1:
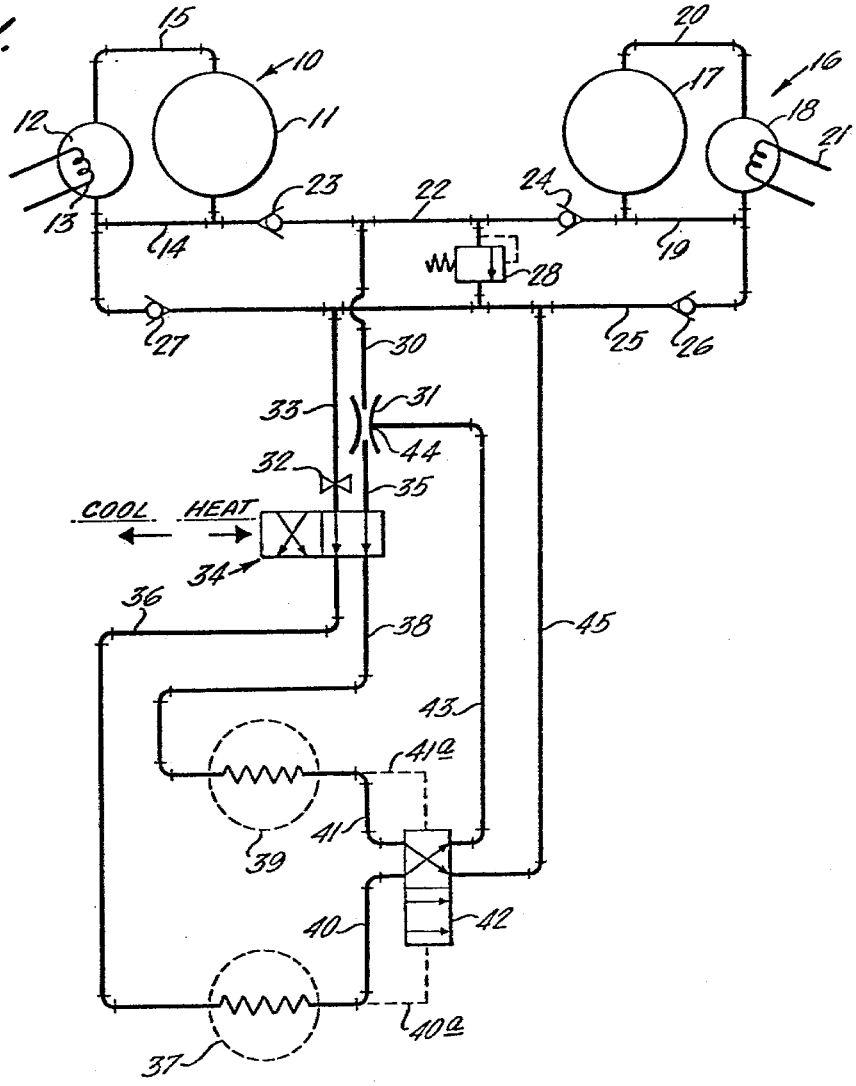
FIG. 1 is a simplified, schematic view illustrating one embodiment of the invention.

Reference is first made to FIG. 1 which shows in schematic form a preferred form of equipment using the principles of the invention for heating and cooling purposes. In FIG. 1, a first refrigerant receiver means 10 comprises a pair of pressure vessels 11 and 12. Means for application of heat, such as an electric heater 13 is provided for the vessel 12 and it should be understood that other heater means may be employed, either alternatively or in combination. For example, vessel 12 may be heated utilizing waste heat from an internal combustion engine in an automotive application, by waste heat from other sources in other application or by heat generated by a solar collector. Vessels 11 and 12 form a part of a system which is adapted to be charged with a refrigerant fluid, preferably a low boiling point refrigerant such as Freon 12. Both vessels are interconnected by means of a conduit 14 interconnecting the bottoms of the vessels and a conduit 15 interconnecting them at the tops. The vessels are positioned and interconnected so that hot refrigerant vapor from vessel 12 displaces unheated liquid refrigerant in vessel 11.

A second refrigerant receiver means 16 comprised of vessels 17 and 18 and interconnected by conduits 19 and 20 is also provided. Vessel 18 is heated by heater means comprising an electric heating element 21. The capacity of the receiver means 16 should be substantially the same as that of receiver means 10. The vessels of the two receiver means are interconnected by a conduit 22 in which is located a check valve 23 and a check valve 24 and a conduit 25 in which check valves 26 and 27 are located. A pressure relief valve 28 is set to allow for the flow of refrigerant from one receiver means to the other at a preselected high value of pressure, as for example 500 psia, in a system using Freon 12 as a refrigerant. Other safety protection can be provided in addition to or in lieu of relief valve 28 if desired.

Conduit means comprising a conduit 30 is connected to conduit 22 so as to receive refrigerant alternately from the first receiver means or the second receiver means as will appear more fully hereinafter. Conduit 30 is connected to the inlet of means such as a venturi device 31 provided with a converging section leading from the high pressure inlet, a throat and a divergent section. It will be understood by those skilled in the art that the venturi device 31 will convert high pressure fluid energy to high velocity fluid energy with a resulting loss in pressure as the velocity of the fluid increases, the throat or region downstream of the throat being the maximum velocity, minimum pressure area. The divergent section downstream of the throat produces a deceleration of the fluid, thus leading to a restoration of the pressure.

A fluid metering or other pressure reducing device which is typically an expansion valve 32 is connected to conduit 25 by means of conduit 33. In some applications, expansion valve could be replaced by a fluid motor capable of driving a blower or a pump for pumping cooling water.

The outlet of expansion valve 32 is connected to one port of a two position control valve 34. The outlet of venturi 31 is connected to a second port of the valve 34 by means of a conduit 35. Valve 34 has a first outlet port to which a conduit 36 is connected, the conduit 36 leading to a first heat exchange device 37 through which the refrigerant is to be circulated. The valve has a second outlet port connected to a conduit 38 which leads to a second heat exchange device 39 through which the refrigerant is to be circulated. The heat exchange devices are connected by conduits 40 and 41 to inlet ports of a two position valve 42. The valve has a pair of outlet ports, one of which is connected to a conduit 43 leading to a low pressure tap 44 of the venturi device 31 and the second of which is connected to a conduit 45 which is connected to conduit 25.

For the purposes of explanation of the operation of the embodiment of the invention illustrated in FIG. 1 and just described, it will be assumed that the refrigerant used is Freon 12 and that the equipment is used for the heating and cooling of a dwelling or other building. In the following explanation where reference is made to pressure and temperature relationships, it may be helpful to refer to FIG. 2 which illustrates the temperature-pressure saturation curve for Freon 12. At the start, assume that the reservoirs or vessels comprising refrigerant receiver means 10 are full of liquid refrigerant at a pressure dictated by the temperature of the atmosphere and that the vessels of receiver means 16 are full of refrigerant vapor. Heat is added to vessel 12 by means such as the heater 13 to maintain a temperature such as 200 degrees F., thus vaporizing the refrigerant and producing a pressure of 430 psia. The pressurized vapor passes through conduit 15 which interconnects the top of the vessels and displaces unheated refrigerant at high pressure through check valve 23, through conduit 30 to the inlet of venturi device 31. If the system is to be employed for cooling, valve 34 is moved to the position shown in FIG. 1. Thus, refrigerant flowing through the venturi and line 35 is passed to line 38, heat exchange device 39, the conduit 41 from which it is passed through valve 42 to line 45 and to line 25.

Line 25 supplies refrigerant to expansion valve 32 by way of line 33 and also returns refrigerant to the unheated receiver means 16 which is at low pressure with respect to receiver means 10.

In order to lower the pressure and thus the vaporization temperature of the refrigerant in the heat exchanger device 37, the outlet end of the heat exchange device 37 is interconnected via conduit 40, valve 42 and conduit 43 to the low pressure tap 44 of the venturi device 31. It should be noted that valve 42 is shifted to the lower position shown during cooling, as for example by application of the pilot pressure to one end of the valve spool via a pilot line 41*a*. Thus, the refrigerant in heat exchanger 37 is vaporized at a very low temperature, due to the low pressure existing downstream from expansion valve 32. Heat is removed from the space surrounding the heat exchanger device by the vaporization of the refrigerant and the heated vapor is carried away through conduit 40 and the conduit 43 into the low pressure tap of the venturi device 31. Within the venturi, it mixes with a high velocity flow of refrigerant and the mixture is discharged at high pressure at the exit of the venturi. The high pressure refrigerant exits through conduit 35, control valve 34, the conduit 38, to the second heat exchange device 39 where it is condensed to a liquid. Assuming an atmospheric temperature of 100 degrees F., the refrigerant will condense to a liquid at 131 psia discharging heat to the atmosphere around heat exchanger 39. This liquid flows out through conduit 41 through the valve 42, conduit 45 through check valve 26 to the second or unheated receiver means and also to the expansion valve. Since check valve 27 is seated at 430 psia, no refrigerant flow is permitted back to the first or heated receiver means at this point.

The fluid passing through check valve 26 fills vessels 17 and 18, the process continuing with heat being absorbed at heat exchanger 37 and rejected at heat exchanger 39, until all refrigerant has been forced from reservoir 11. The high pressure, hot vapor from reservoir 12 is then exhausted through the venturi 31 through valve 34 and is condensed in heat exchanger 39, equalizing the system pressure at 131 psia, assuming the condenser is operating at an atmospheric temperature of 100° F.

At this time, all liquid refrigerant has been stored in the second receiver means. The control circuit switches the application of heat from vessel 12 to vessel 18 and the cooling cycle begins again in the manner described above.

In use of the system of FIG. 1 for heating, selector valve 34 is shifted to the right hand position. In this position, the outlet of the venturi device 31 is interconnected with heat exchanger device 37 via the line 36 so that refrigerant at high pressure and temperature passes through this device. Pilot line 40*a* applies a pressure to the lower end of the spool of valve 42 to shift that valve upwardly as viewed in FIG. 1. Fluid exiting from heat exchange device 37 passes to line 40, line 45, and line 25. As noted above the refrigerant then flows through expansion valve 32 via line 33 and also flows to the unheated receiver means 16. The fluid exiting from expansion valve 32 is delivered to the heat exchanger 39, which as noted above, is exposed to the atmosphere. Due to the expansion valve, this refrigerant is at low pressure. The pressure in this heat exchanger is further reduced due to its connection to the low pressure venturi tap by way of lines 41 and 43. Thus, heat can be withdrawn from the atmosphere at very low temperature and the heated refrigerant is drawn into the stream of high velocity refrigerant at the low pressure tap of the venturi and delivered via line 35, the cross passage of valve 34, and line 36 to the heat exchanger 37 where this heat is given up to the space to be heated.

Figure 2:
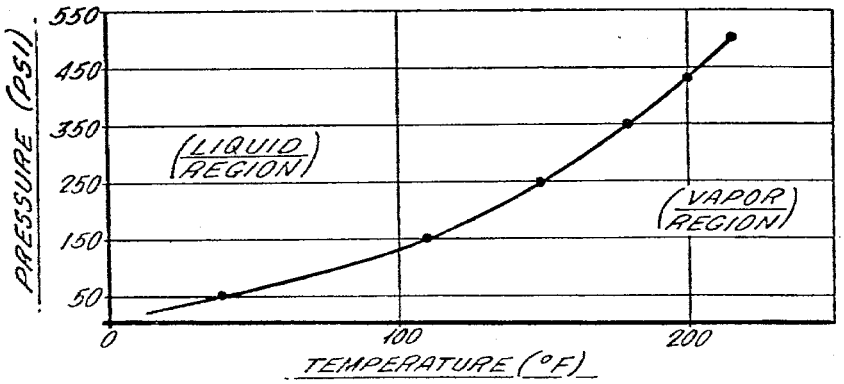
FIG. 2 is a pressure temperature saturation curve of a typical refrigerant, namely Freon 12.

By way of example, as can be seen from FIG. 2, at a pressure of 10 psia, Freon 12 will boil at minus 37° F., thus collecting heat even on very cold days, which can be released in heat exchanger 37 after the refrigerant is compressed at the exit of the venturi.

Figure 3:
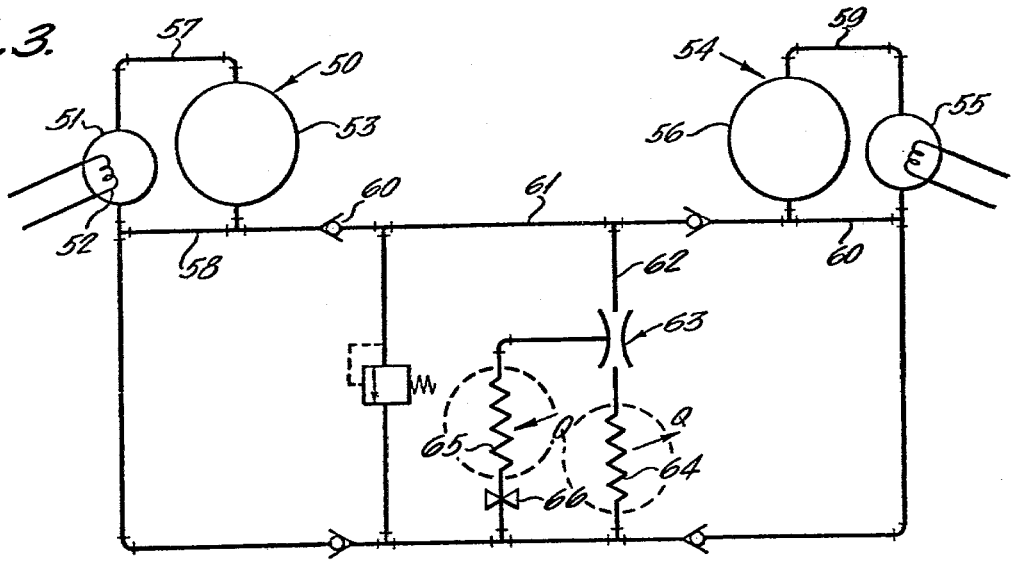
FIG. 3 is a schematic showing of another embodiment of the invention.

FIG. 3 shows a simplified version of the invention of FIG. 1 wherein the system is intended for heating only or cooling only.

According to the embodiment of FIG. 3, the first reservoir means 50 comprises a relatively small tank or reservoir 51 provided with means for application of heat represented by heating element 52. The first receiver means also comprises a second vessel or tank 53 which contains a supply of unheated refrigerant. Similarly, second receiver means 54 comprises heated tank or reservoir 55 and unheated tank or reservoir 56. Conduits 57, 58 and 59, 60 interconnect the tanks of the respective receiver means.

In the embodiment of FIG. 3, refrigerant flow from the first receiver means is caused by the displacement of liquid refrigerant of vessel 53 by vaporized refrigerant heated in vessel 51. Liquid refrigerant flows through check valve 60, conduit 61 and conduit 62 to the inlet of a venturi device 63. First and second heat exchange devices 64 and 65 are located downstream from the venturi device. An expansion valve 66 is located between the two heat exchange devices. The exit end of heat exchange device 65 is connected to the low pressure tap of venturi device 63 by means of a conduit 68.

If the system just described is to be used for cooling only, heat exchanger 65 is located where cooling is required and functions as an evaporator withdrawing heat from its surroundings as the refrigerant vaporizes. Heat exchanger 64 functions as a condenser and is located in a position where it can reject heat obtained from the heat exchanger 65. The same system is useful for heating, in which case the location of the heat exchangers is simply reversed.

The equipment of FIG. 3 operates similarly to that of FIG. 1 in that control means, not shown in FIG. 3, first applies heat to vessel 51 until liquid refrigerant at high pressure is forced from vessel 53 through the venturi device, heat exchanger 64 and the expansion valve and heat exchanger 65, and to the vessels of the second receiver means. When the vessels of the second receiver means are filled, the control means reverses the cycle, starting with application of heat to vessel 55 and ending when all liquid refrigerant has been transferred back to the vessels of the first receiver means. During each part of the cycle, heat is yielded by the refrigerant in heat exchanger 64 as condensation occurs and is absorbed by the refrigerant in heat exchanger 65 as vaporization occurs.

Figure 4:
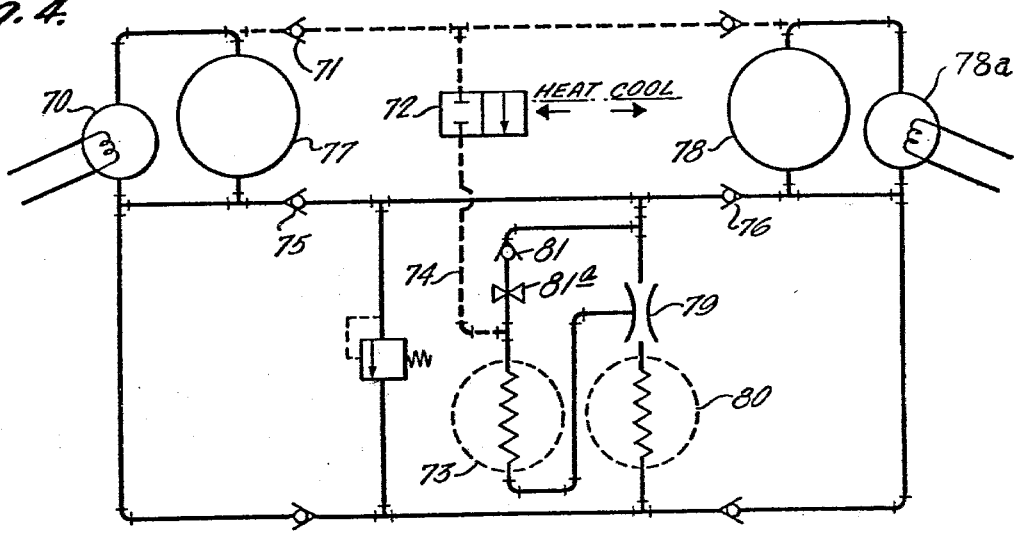
FIG. 4 is a view of still another form of the invention.

In the embodiment of FIG. 4, when used in the heating mode, selector valve 72 is shifted from the closed position shown to a position in which a flow passage through the valve is opened. Hot vapor from the top of heated tank 70 will flow through check valve 71, through the selector valve 72, directly to heat exchanger 73 via line 74. A pair of check valves 75 and 76 have a small cracking pressure so that liquid from the tank 77 and 78 does not enter the venturi 79 during this mode of operation. Thus, hot vapor enters the heat exchanger 73 which transfers heat to the system to be heated. Refrigerant from heat exchanger 73 flows through the low pressure tap of the venturi 79 and from there flows through the second heat exchanger 80 to fill vessels 78 and 78*a*, as these vessels are unheated and at low pressure with respect to the receiver 50. In the cooling mode, the system operates above as described with reference to FIG. 3. Briefly stated, in this mode, valve 72 is in the position indicated and heated refrigerant vapor driven from vessel 70 displaces vapor from vessel 77 and through check valve 75. Downstream from check valve 75 the refrigerant path is divided with one path extending through check valve 81 and expansion valve 81*a*, the heat exchanger 73 and the low pressure tap of venturi 79 from which it passes through heat exchanger 80 to the unheated receiver means. The other path extends through venturi 79. The system of FIG. 4 is a simple low cost system useful when large amounts of waste heat are available for heating purposes.

As in the other embodiments of the application of heat to one receiver means causes a flow of refrigerant from that receiver means through the system to the unheated receiver means. When the refrigerant supply in the first receiver means is exhausted, control means such as described hereinafter remove the application of heat from that receiver means and cause heat to be supplied to the vessel of the other receiver means. The pressure generated causes a flow through the conduit means to the unheated receiver means.

Figure 5:
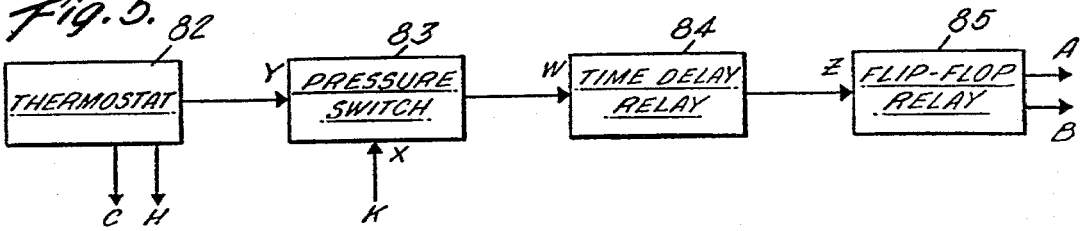
FIG. 5 shows in block diagram form a control system suitable for operation of systems made according to the invention.

FIG. 5 discloses a suitable control means for operation of equipment formed in accordance with the invention. According to FIG. 5, which is hereinafter described as operating the embodiment of the invention of FIG. 1, a thermostat 82 is provided having a pair of switching devices labeled C & H which shift control valve 34 of FIG. 1 depending upon whether heating or cooling is called for. A pressure switch 83 is actuated when the pressure is below a predetermined pressure value within conduit 43 in FIG. 1. If temperature correction is required, thermostat 82 switches on, supplying two output signals, one to valve 34 of FIG. 1 and the second to the pressure switch 83. If the pressure switch is on, due to pressure in conduit 43, the second output of the thermostat is applied to time delay relay 84. An input to time delay relay 84 causes an output of predetermined duration to be applied to flip-flop 85, causing a signal on one of the flip-flop outputs A or B, which in turn activates the associated heater 13 or 21. At the end of the time interval, after time delay relay 84 has switched off, a signal from the pressure switch 83, (being indicative of the fact that the pressure in conduit 30 is still low) will reactivate the time delay relay 84 which will apply another input to the flip-flop 85, causing a switching of the flip-flop so as to activate the heater for the other tank. It should be apparent that if the initial activation of the flip-flop results in the energization of the heater in a vessel which only contains vapor, the pressure switch 83 will reactivate the time delay relay 84 immediately after it shuts off causing another impulse of predetermined duration on the flip-flop, which causes a switching of outputs and an output pulse to the appropriate heater of predetermined duration. Switching from one heater to the other will continue so long as the thermostat is calling for heating or cooling and the pressure is above the predetermined value.

In summary, the invention provides a simple and effective energy transfer system using heat as an energy source for providing heating or cooling as required. The system is well adapted for use of heat from solar collectors, waste heat from automobile engines and other sources or the like. In automobile applications it requires no shaft horsepower and instead makes use of the heat removed by the cooling system of the automobile engine, thus increasing fuel economy. The only moving parts are shuttle valves and check valves, the shuttle valves only switching at seasonal changes. The systems incorporating the principles of the invention can be readily completely sealed, there being no shaft seals through which refrigerant fluid is apt to leak as in a conventional compressor as the compressor deteriorates with age.

I claim:

1. A heat transfer system comprising a refrigerant receiver including a pair of interconnected pressure vessels adapted to contain a supply of low boiling point liquid refrigerant, means for application of heat to the refrigerant in a first vessel of said pair with accompanying rise in pressure thereby causing a flow of vaporized refrigerant under pressure to the second vessel, conduit means connected to the second vessel of said pair for circulation of liquid refrigerant displaced from said second vessel by the pressurized vapor from the first vessel, said conduit means including a venturi device having an inlet connection to the second vessel and an outlet, a low pressure tap, an expansion valve, a heat exchange device downstream from the expansion valve, said conduit means establishing a first flow path for pressurized liquid refrigerant from the second vessel through the venturi device and a second flow path through the expansion valve, and means extending said second flow path from the expansion valve through the heat exchange device to the low pressure venturi tap for passage of refrigerant at a sufficiently low pressure to effect vaporization downstream of the expansion valve and thereafter through the heat exchange device.

2. A heat transfer system according to claim 1 further comprising a second heat exchange device, said conduit means further providing for circulation of pressurized liquid refrigerant from the venturi device outlet through the second heat exchange device to the second flow path.

3. A system according to claim 2, said conduit means further including selector valve means selectively moveable from a first control position in which the first named heat exchange device is interconnected between the expansion valve and low pressure venturi tap and the second heat exchange device is interconnected between the outlet of the venturi device and the inlet of the expansion valve and a second control position in which the first named heat exchange device is interconnected between the outlet of the venturi device and the expansion valve inlet and the second heat exchange device is interconnected between the expansion valve and the low pressure venturi tap.

4. A heat transfer system comprising first and second refrigerant receiver means, each of said receiver means comprising a pair of interconnected pressure vessels, the vessels of one of said receiver means being adapted to contain a charge of low boiling point refrigerant in liquid form and having means for application of heat to the charge in a first vessel of a pair of interconnected vessels with accompanying rise in pressure, means interconnecting the first and second vessels of each pair of receiver means for refrigerant vapor flow from the heated vessel to the unheated vessel of a pair, conduit means establishing a flow path from one pair to the other for passing liquid refrigerant displaced from the second vessel in a pair through the conduit means to the other receiver means, a venturi in said conduit means having an inlet and an outlet and a low pressure tap, a first heat exchange device, said conduit means establishing a first flow path for liquid refrigerant from the unheated vessel of the one receiver means through the venturi, from the venturi to the first heat exchange device and from the first heat exchange device to the other receiver means whereby a flow of high pressure liquid refrigerant through the venturi and the first heat exchange device is established, said conduit means further comprising a pressure reducing device, a second heat exchange device downstream from the pressure reducing device, said conduit means further establishing a second refrigerant flow path from the first heat exchange device, through the pressure reducing device and the second heat exchange device to the low pressure tap of the venturi, said low pressure tap maintaining a low pressure in the second heat exchange device, whereby gaseous refrigerant at low pressure is aspirated through the second heat exchange device.

5. A heat transfer system according to claim 4 further comprising control means responsive to the transfer of the refrigerant from one to the other of said receiver means for application of heat to the first vessel of the other of said receiver means, said conduit means including valve means operative in response to application of heat to the first vessel of the other of said receiver means by said control means for passing liquid refrigerant displaced from the unheated vessel of said other pair through the first and second flow paths to the first receiver means.

6. A heat transfer system according to claim 5 wherein said valve means comprises check valves operative to channel flow from the receiver means at the higher pressure to the receiver means at the lower pressure.

7. A heat transfer system comprising first and second refrigerant receiver means, each of said receiver means comprises a pair of interconnected pressure vessels, one of said receiver means being adapted to contain a charge of low boiling point refrigerant in liquid form and having means for application of heat to the charge in a first vessel of said pair of interconnected vessels with accompanying rise in pressure, conduit means interconnecting the first and second vessels of each pair of receiver means for refrigerant flow from the heated vessel to the unheated vessel of a pair, said conduit means further establishing a flow path between said pairs of receiver means for passing liquid refrigerant displaced from the second vessel of a pair by heated vapor from the first vessel of the pair, said conduit means including a venturi having an inlet and an outlet and a low pressure tap, an expansion valve, first and second heat exchange devices and a selector valve, means including said selector valve for establishing in one position of the selector valve a first flow path for liquid refrigerant displaced by heated vapor through the venturi, from the venturi to the first heat exchange device and a second flow path from the first heat exchange device through the pressure reducing device and the second heat exchange device to the low pressure tap of the venturi, said selector valve establishing in the other position a first flow path through the venturi through the second heat exchange device and the second flow path from the second heat transfer device, through the pressure reducing device, the first heat transfer device to the low pressure tap of the venturi, said low pressure tap maintaining a sufficiently low pressure to aspirate gaseous refrigerant through the heat transfer device in the second flow path.

8. Apparatus according to claim 7 further including control means responsive to the transfer of the refrigerant from one to the other of said receiver means for application of heat to the first vessel of the other of said receiver means, said conduit means including valve means operative in response to application of heat to the first vessel of the other of said receiver means by said control means for passing liquid refrigerant displaced from the unheated vessel of said other pair through first and second flow paths to the first receiver means.

9. A system according to claim 8 wherein said control means further comprises a thermostat, a pressure responsive device operative at pressures below a predetermined level to produce an output in response to an output signal from said thermostat for activating one of said heat application means for a predetermined time period, and further including means responsive to the next succeeding output signal from the pressure responsive device for activation of the other heat application means.

* * * * *